US007119768B2

(12) United States Patent
Yazawa et al.

(10) Patent No.: US 7,119,768 B2
(45) Date of Patent: Oct. 10, 2006

(54) APPARATUS AND METHOD FOR DRIVING LUMINESCENT DISPLAY PANEL

(75) Inventors: Naoki Yazawa, Yamagata (JP); Koji Henmi, Yamagata (JP); Gen Suzuki, Yamagata (JP); Keisuke Moriya, Yamagata (JP); Takeshi Okuyama, Yamagata (JP)

(73) Assignee: Tohoku Pioneer Corporation, Yamagata (JP)

( * ) Notice: Subject to any disclaimer, the term of this patent is extended or adjusted under 35 U.S.C. 154(b) by 121 days.

(21) Appl. No.: 10/211,380

(22) Filed: Aug. 5, 2002

(65) Prior Publication Data

US 2003/0043090 A1 Mar. 6, 2003

(30) Foreign Application Priority Data

Sep. 6, 2001 (JP) ..... P2001-269941

(51) Int. Cl.

*G09G 3/30* (2006.01)
*G09G 5/00* (2006.01)
*G09G 3/10* (2006.01)
*G09G 5/10* (2006.01)

(52) U.S. Cl. ..... 345/76; 345/82; 345/212; 345/690; 315/169.1; 315/169.2; 315/169.3

(58) Field of Classification Search ..... 345/36, 345/45, 76–81, 690, 691, 208, 211, 214, 82–83; 315/169.3, 169.1

See application file for complete search history.

(56) References Cited

U.S. PATENT DOCUMENTS 5,594,463 A 1/1997 Sakamoto
5,723,950 A * 3/1998 Wei et al. ..... 315/169.3
6,144,165 A 11/2000 Liedenbaum
6,201,584 B1 * 3/2001 Sonehara et al. ..... 349/38
6,335,713 B1 * 1/2002 Imai ..... 345/76
6,501,226 B1 * 12/2002 Lai et al. ..... 315/169.1
6,580,657 B1 * 6/2003 Sanford et al. ..... 365/230.05
6,587,087 B1 * 7/2003 Ishizuka ..... 345/82
6,608,448 B1 * 8/2003 Boer ..... 315/169.3
6,677,925 B1 * 1/2004 Kawaguchi et al. ..... 345/98
6,707,438 B1 * 3/2004 Ishizuka et al. ..... 345/78
6,714,177 B1 * 3/2004 Ishizuka ..... 345/76
6,731,276 B1 * 5/2004 Ishizuka ..... 345/211
6,747,617 B1 * 6/2004 Kawashima ..... 345/76
6,778,154 B1 * 8/2004 Van Velzen ..... 345/76
2001/0030633 A1 * 10/2001 Van Velzen ..... 345/76
2003/0071821 A1 * 4/2003 Sundahl et al. ..... 345/589

FOREIGN PATENT DOCUMENTS

JP 9-232074 9/1997
WO WO 01/20591 A1 3/2001

* cited by examiner

*Primary Examiner*—Henry N. Tran
(74) *Attorney, Agent, or Firm*—Sughrue Mion, PLLC

(57) ABSTRACT

In an apparatus for driving a luminescent display panel, in a state in which scanning lines are sequentially scanned to drive and illuminate light-emitting elements, a voltage peak value arising in a scanning line in a non-scanning state is held by a capacitor through parasitic capacitance of the light-emitting element in a non-scanning state. On the basis of the voltage value held by the capacitor, a reverse bias voltage to be output from a reverse bias voltage generation circuit is controlled, and the voltage is supplied to the scanning lines.

23 Claims, 6 Drawing Sheets

APPARATUS AND METHOD FOR DRIVING LUMINESCENT DISPLAY PANEL

BACKGROUND OF THE INVENTION

1. Field of the Invention

The present invention relates to a technique for driving a capacitive light-emitting element; e.g., an organic electroluminescence (EL) element, to emit light. Particularly, the invention relates to an apparatus and method for driving a luminescent display panel which suppresses occurrence of crosstalk illumination of EL elements and can offer a suitable luminous brightness characteristic by means of appropriately controlling a reverse bias voltage to be applied to cathode scanning lines in a non-luminous state, as required, when a display panel having a plurality of organic EL elements arranged thereon is driven.

2. Description of the Related Art

An organic EL display has already been put into actual use in some quarters as a display which serves as an alternative to a liquid-crystal display and enables realization of low power consumption, high display quality, and a lower profile. An underlying backdrop to this is that the efficiency and life of an EL display have been improved to a practical level, by use of an organic compound—which can be expected to yield a superior light-emitting characteristic—for a light-emitting layer which is made of EL elements and is to be used for an EL display.

The organic EL element can be electrically represented as an equivalent circuit as shown in FIG. 4. The organic EL element can be replaced with a configuration consisting of a diode component E and a parasitic capacitance component Cp connected in parallel with the diode component E. The organic EL element is considered to be a capacitive light-emitting element. Illumination is considered to be effected in the following manner. When a luminous drive voltage is applied to the organic EL element, electric charges corresponding to the electrical capacitance of the element flow into and are stored in electrodes as a displacement current. Subsequently, when the electric charges have exceeded a given voltage inherent to the element (an emission threshold value=Vth), an electric current starts flowing from the electrode (i.e., the anode of the diode component E) into an organic layer constituting the light-emission layer. The light-emission layer illuminates at an intensity proportional to the electric current.

FIGS. 5A to 5C show a static light-emission characteristic of such an organic EL element. As shown in FIG. 5A, when a drive voltage (V) exceeds the emission threshold-value voltage (Vth), an electric current (I) abruptly flows into the organic EL element, whereupon the EL element illuminates. In other words, if the applied drive voltage is lower than the emission threshold-value voltage, a drive current does not flow into the EL element after recharging of the parasitic capacitance, and hence the EL element does not illuminate. As shown in FIG. 5B, within a light-generative domain in which the drive voltage (V) exceeds the emission threshold-value voltage, the EL element has a characteristic of illuminating at luminance (L) substantially proportional to the drive current (I). Consequently, as shown in FIG. 5C, within the light-generative domain in which the drive voltage (V) exceeds the threshold-value voltage the EL element has a luminance characteristic such that light-emission luminance of the EL element becomes greater as the value of the voltage (V) applied to the same increases.

The organic EL element has a characteristic of the physical properties thereof changing with long-term use and the resistance thereof becoming greater. As shown in FIG. 5A, with lapse of operating time a V—I characteristic of the organic EL element changes in the direction indicated by the arrowhead (i.e., assumes a characteristic designated by broken lines). Consequently, the luminance characteristic of the EL element also deteriorates.

The luminance characteristic of the organic EL element is also known to change roughly in the manner as indicated by broken lines in FIG. 5C according to an ambient temperature. Specifically, within the light-generative domain in which the drive voltage (V) exceeds the emission threshold-value voltage, the EL element has a characteristic of light-emission luminance (L) thereof becoming greater as the voltage (V) applied to the element becoming greater. However, the emission threshold-value voltage becomes lower as ambient temperature rises. Consequently, when heated to a higher temperature, the EL element becomes able to emit light at a lower applied voltage. Further, in relation to luminance, the EL element has temperature dependence of illuminating brightly at a high temperature and illuminating dimly at a low temperature even when a light-generative voltage has been applied to the EL element.

As a method of driving a display panel constituted by arranging a plurality of organic EL elements, a simple matrix drive system is applicable. FIG. 6 shows an example of a simple matrix display panel and a drive unit therefor. A method of driving organic EL elements of the simple matrix drive system includes two methods; that is, a method of scanning cathode lines and driving anode lines, and a method of scanning anode lines and driving cathode lines. The configuration shown in FIG. 6 is associated with the former method; that is, a method of scanning cathode lines and driving anode lines. More specifically, anode lines A1 through An serving as "n" drive lines are arranged in the vertical direction, and cathode lines B1 through Bm serving as "m" scanning lines are arranged in the horizontal direction. Organic EL elements (OEL) assigned diode symbols are disposed at respective intersections between the cathode and anode lines (a total of "n"×"m").

The EL elements constituting pixels are arranged in a grid pattern. The EL elements constituting pixels are provided in corresponding intersections between the positive drive lines A1 through An laid vertically and the cathode scanning lines B1 through Bm laid horizontally. Each of the EL elements is connected at one end (e.g., an anode terminal of the diode component E in the previously-described equivalent circuit) to an anode drive line and at the other end (e.g., a cathode terminal of the diode component E in the equivalent circuit) to a cathode scanning line. The anode drive line is connected to and driven by an anode line drive circuit 2, and the cathode scanning line is connected to and driven by a cathode line scanning circuit 3.

The cathode line scanning circuit 3 is equipped with scanning switches SY1 through Sym corresponding to the respective cathode scanning lines B1 through Bm. The cathode line scanning circuit 3 operates so as to connect, to a corresponding cathode scanning line, either a reverse bias voltage (VM) output from a reverse bias voltage generation circuit 5 for preventing occurrence of crosstalk illumination, or a ground potential serving as a reference potential. Further, the anode line drive circuit 2 is equipped with constant current circuits I1 through In and drive switches SX1 through SXn, wherein the constant current circuits I1 through In act as constant current sources for supplying drive currents to the respective EL elements through corresponding anode drive lines.

The drive switches SX1 through SXn act so as to connect to corresponding anode lines either ground potential or the electric current output from the constant current circuits I1 through In. Hence, the drive switches SX1 through SXn are connected to the constant-current circuits I1 through In, whereby the electric currents output from the constant current circuit I1 through In are supplied to the respective EL elements arranged so as to correspond to the cathode scanning lines.

A drive source, such as a constant voltage circuit, may be used in place of the constant current circuit. The current/luminance characteristic of the EL element is stable, whereas a voltage/luminance characteristic of the same is unstable. In addition, a constant current circuit is generally used as a drive source, as shown in FIG. 6, for reasons of preventing deterioration of the element, which would otherwise be caused by excessively high current.

The anode line drive circuit 2 and the cathode line scanning circuit 3 are connected to an illumination control circuit 4 by way of control buses. On the basis of an image signal which is to be supplied to the illumination control circuit 4 and to be displayed, the scanning switches SY1 through Sym and the drive switches SX1 through SXn are actuated. On the basis of the image signal, the cathode scanning lines are set to a reference potential at predetermined cycles, and the constant current circuit is connected to a desired anode line. As a result, the respective light-emitting elements are selectively illuminated, whereupon an image is reproduced on the display panel 1 in accordance with the image signal.

A DC output (a drive voltage=VCOM) output from a booster circuit 6 constituted of a DC-DC converter is supplied to the respective constant current circuits I1 through In in the anode line drive circuit 2. The booster circuit 6 which is constituted of a DC-DC converter and will be described later produces a d.c. output through pulse width modulation (PWM) control. Alternatively, pulse frequency modulation (PWF) may be utilized.

The DC-DC converter is configured such that an n-p-n transistor Q1 serving as a switching element is activated at a predetermined duty cycle by means of a PWM waveform output from the switching regulator circuit 11. By means of activation of the transistor Q1, the electric power energy output from a DC voltage source 12 is accumulated in an inductor L1. In association with deactivation of the transistor Q1, the electric power energy accumulated in the inductor is stored in a capacitor Cl via a diode D1. Through repeated activation and deactivation of the transistor Q1, a boosted DC output can be obtained as a terminal voltage of the capacitor C1.

The DC output voltage is divided by a parallel circuit constituted of a resistor R3 and a thermistor TH1 for temperature compensation and at a junction between a resistor R1 and a resistor R2 connected in series with the parallel circuit. The thus-divided output voltage is supplied to an error amplifier 14 in the switching regulator circuit 11, the amplifier being constituted of an operational amplifier. The error amplifier 14 compares the output voltage with a reference voltage Vref. A comparison output (i.e., error output) is supplied to the PWM circuit 15, thereby controlling the duty cycle of a signal wave output from an oscillator 16. In this way, the DC-DC converter is subjected to feedback control such that the output voltage is maintained at a predetermined constant voltage.

By means of the configuration shown in FIG. 6, the thermistor TH1 is inserted into the feedback system so as to provide feedback to the error amplifier 14. The output voltage Vout produced by the DC-DC converter 6 is adjusted by means of the temperature characteristic of the thermistor TH1. Eventually, the reverse bias voltage VM—which is produced by means of dividing the output voltage Vout and will be described later—is varied in accordance with ambient temperature. Here, the output voltage Vout produced by the DC-DC converter 6 can be expressed as follows. In the following equation, "TH1//R3" denotes a parallel combined resistance value produced from the resistance of the thermistor TH1 and that of the resistor R3.

$$Vout = Vref \times [(R1+R2+TH1//R3)/R1]$$

The reverse bias voltage generation circuit 5 utilized for preventing occurrence of the foregoing crosstalk illumination is constituted of a potential dividing circuit for dividing the output voltage Vout. The potential dividing circuit is constituted of resistors R4, R5 and an n-p-n transistor Q2 serving as an emitter follower. Therefore, when a base-emitter voltage in the transistor Q2 is taken as Vbe, the reverse bias voltage VM produced by the potential dividing circuit can be approximated as follows.

$$VM = Vout \times [R5/(R4+R5)] - Vbe$$

In the foregoing configuration, the illumination control circuit 4 controls the drive switches SX1 through SXn in the anode line drive circuit 2 in accordance with an image signal while scanning the cathode lines B1 through Bm in the cathode line scanning circuit 3 at a predetermined cycle, thus selectively connecting the constant-current circuits I1 through In to the respective anode drive lines A1 through An. At this time, the reverse bias voltage VM output from the reverse bias voltage generation circuit 5 is applied to the cathode lines in a non-scanning state. As a result, the EL elements connected to the interconnections between the anode line being driven and the cathode lines not selected for scanning operate so as to prevent occurrence of crosstalk illumination.

As mentioned previously, the organic EL element has the parasitic capacitance Cp. For instance, there is taken as an example a case where one anode drive line is connected to tens of EL elements, from the viewpoint of the anode drive line having a combined capacitance—which is greater than each parasitic capacitance by an order of magnitude—being connected to the anode drive line as load capacitance.

Consequently, the electric current output from the anode drive line at the leading end of a scanning period is spent in recharging the load capacitance. If the load capacitance is recharged until the emission threshold-value voltage of the EL element is sufficiently exceeded, a time lag will arise. This eventually presents a problem of a delay arising in start-up of the EL element. As mentioned previously, particularly in the case where the constant current sources II through In are used as a drive source, the constant current sources correspond to high-impedance output circuits in terms of principle of operation. Hence, a limitation is imposed on an electric current, thereby inducing a noticeable delay in the rise and illumination of the EL element.

The drive circuit of this type usually adopts a cathode resetting method. The cathode resetting method is described in, e.g., Japanese Patent Application Laid-Open No. 2320074/1997. When one scanning line has been switched to another scanning line, the method acts so as to speed up the rise and illumination of an EL element which is to be driven and illuminated by the current scanning line.

The drive switches SX1 through SXn provided in the anode line drive circuit 2 are connected to either the constant current sources I1 through In or the ground potential. When the switches SX1 through SXn are connected to the ground potential, the drive anode lines are set to the ground potential. Consequently, the cathode resetting method can be realized by utilization of the drive switches SX1 through SXn.

FIGS. 7A to 7D are illustrations for describing a cathode resetting operation. For instance, there is shown that a shift arises from a state in which an EL element E11 connected to the first anode drive line A1 is driven and activated to another state in which an EL element E12 connected to the first anode drive line A1 is driven and illuminated. In FIGS. 7A through 7D, an EL element to be driven and illuminated is depicted as a diode symbol, and the other EL elements are depicted as symbol of capacitors serving as parasitic capacitance.

FIG. 7A shows a state in which a cathode resetting operation is performed and in which the EL element E11 is illuminated as a result of a cathode line B1 having been scanned. The EL element E2 is to be illuminated through next scanning operation. However, before illumination of the EL element E12, the anode drive line A1 and all cathode scanning lines are reset to the ground potential as shown in FIG. 7B, thereby discharging all electric charges from the respective EL elements. To this end, the scanning switches SY1 through SYm are connected to ground, and the drive switch SX1 is connected to ground. In order to illuminate the EL element E12, a cathode scanning line B2 is scanned. In other words, the cathode scanning line B1 is grounded, and the remaining cathode scanning lines are given the reverse bias voltage VM. At this time, the drive switch SX1 is switched to the constant current source I1.

At the time of resetting operation, electric charges, which correspond to parasitic capacitance of the respective EL elements, are discharged. At this moment, as shown in FIG. 7C, the parasitic capacitance of the EL elements, except the EL element E12 which is to be illuminated next, is charged with the reverse bias voltage VM in a reverse direction as indicated by an arrow. This charging current flows into the EL element E12 to be illuminated next, via the anode drive line A1, thereby charging the parasitic capacitance of the EL element E12. At this time, as mentioned previously, the constant current source I1 connected to the drive line A1 in principle corresponds to a high-impedance output circuit. Hence, the constant current source I1 does not affect the flow of the charging current.

Provided that, for example, 64 EL elements are provided in the drive line A1 and that the reverse bias voltage is, e.g., 10(V), the potential V (A1) of the anode drive line A1 momentarily rises to a potential defined by Eq. 3 provided below through recharging operation, because line impedance of the panel is negligibly small. For instance, in the case of a display panel having outer dimensions of about 100 mm×25 mm (256×64 dots), a rise in the potential of the anode drive line is completed at about 1 μsec.

$$V(A1)=(VM\times 63+0V\times 1)/64=9.84V$$

By means of the drive current which flows through the drive line A1 and originates from the constant current source I1, the EL element E12 is brought into an illuminating state, as shown in FIG. 7D. As has been described, the cathode resetting method acts so as to instantaneously increase the forward voltage of the next EL element be driven and illuminated, by utilization of parasitic capacitance of EL elements, which would originally hinder operation thereof, and a reverse bias voltage for preventing occurrence of crosstalk illumination.

When the cathode resetting method set forth is utilized, the forward voltage of an EL element to be driven and illuminated through the next scanning operation is started momentarily, and the EL element is driven and illuminated upon receipt of a drive current from the constant current source. Consequently, if the value of the reverse bias voltage VM is set higher, occurrence of crosstalk illumination can be effectively inhibited. Further, an initial charging voltage—which is a forward voltage to be supplied to an EL element to be illuminated through the next scanning operation—increases correspondingly. Therefore, at first glance the cathode resetting method is considered to be preferable. However, if the value of the reverse bias voltage VM is set excessively high, a so-called leakage phenomenon will arise, thereby deteriorating the display grade of the display panel. For this reason, in relation to a related-art drive circuit of this type, the reverse bias voltage VM is set to a fixed voltage close to the forward voltage Vf of the EL element.

As has been described by reference to FIG. 5A, the EL element of this type involves a problem of a forward voltage increasing with time. Further, as has been described by reference to FIG. 5C, the EL element of this type also involves a problem of a forward voltage varying in accordance with ambient temperature. For instance, in a case where a rise has arisen in a forward voltage after long-term use, a discrepancy gradually develops between a voltage VM with which an EL element is initially charged immediately before a scanning operation and the forward voltage Vf of the EL element, because the reverse bias voltage VM is a fixed voltage. Consequently, a delay arises in the time at which an EL element starts illuminating by means of an initial charging operation using the fixed reverse bias voltage VM, along with a problem of the quantity of illumination of the EL element gradually decreasing. In other words, a period during which a predetermined quantity of illumination of the EL element can be ensured is shortened, thereby turning into another problem of the life of the EL element becoming essentially short.

In addition to the changes with time and temperature dependence set forth, variations in film growth (deposition) treatment performed at the time of producing an EL element induce variations in the forward voltage of the EL element of this type. The EL element of this type involves a problem of a forward voltage changing according to the color of illumination, such as red (R) illumination, green (G) illumination, or blue (B) illumination. Eventually, variations arise in the light-emission luminance of the EL element.

Even in a case where a generation circuit constituted of a resistive divider and an emitter follower such as that shown in FIG. 6 is adopted as means for generating a reverse bias voltage VM, if the forward voltage Vf is higher than the reverse bias voltage VM, there arises a phenomenon of variations arising in an electric current which flows through an emitter-follower resistor via parasitic capacitance of respective EL elements in a non-scanning line in accordance with the number of elements illuminating in the display panel and with illumination luminance of the same. Therefore, the reverse bias voltage VM fluctuates, and variations arise in a potential difference between the reverse bias voltage VM and the forward voltage Vf of the element, eventually inducing variations in the illumination luminance of the EL element.

As shown in FIG. 6, even if the thermistor TH1 is used to consequently subject the reverse bias voltage VM to temperature compensation, the thermistor TH1 responds to temperature compensation slowly. Further, a temperature compensation curve does not necessarily match the characteristic of the EL element. For these reasons, difficulty is encountered in achieving a satisfactory compensation characteristic. Under ideal arrangement of the thermistor, the thermistor is brought into thermally intimate contact with a display panel. However, in reality, adoption of such a configuration is difficult, thereby posing difficulty in arranging and designing a thermistor.

SUMMARY OF THE INVENTION

The present invention has been conceived while paying attention to the foregoing problems and aims at providing an apparatus and method for driving a luminescent display panel which can stabilize light-emission luminance of light-emitting elements typified by the previously-described organic EL elements without involvement of adjustment and which can essentially prolong the operating life of the light-emitting elements.

The present invention has been conceived to achieve the object and is characterized by an apparatus for driving a luminescent display panel, the panel including a plurality of drive lines and scanning lines, which cross each other, and a plurality of capacitive light-emitting elements, wherein the light-emitting elements are connected to the drive lines and scanning lines at respective interconnections and have polarities, the apparatus comprising:

reverse bias voltage generation means which changes a value of a reverse bias voltage to be applied to the scanning lines in accordance with a forward voltage value of the light-emitting element obtained in an illuminated state, as required.

In this case, a voltage corresponding to the forward voltage value of the light-emitting element obtained in an illuminated state is preferably acquired from a line voltage of the scanning line obtained when the light-emitting element is in a non-scanning state. In a preferred mode, scanning switches are connected to the respective scanning lines, and a reverse bias voltage produced by the reverse bias voltage generation means is applied to the respective scanning lines via the respective scanning switches; and a line voltage of a scanning line in a non-scanning state is acquired by way of a corresponding scanning switch.

Preferably, the apparatus for driving a luminescent display panel further comprises:

peak holding means for holding a peak value of a line voltage of a scanning line in a non-scanning state, wherein a value of the reverse bias voltage produced by the reverse bias voltage generation means is controlled on the basis of a peak value held by the peak holding means. In addition, the peak holding means is preferably equipped with electric discharging means for gradually discharging a held peak value.

Preferably, the peak holding means has peak value resetting means capable of instantaneously resetting a held peak value. Preferably, the peak value resetting means is configured so as to perform a resetting operation in accordance with an instruction signal output from a light-emission control circuit which drives a luminescent display panel in accordance with an image signal.

Preferably, the reverse bias voltage generation means is constituted of a voltage buffer circuit which produces a reverse bias voltage in accordance with a peak value held by the peak holding means. In this case, feedback level adjustment means is provided in a loop path from an input terminal of the peak holding means to an output terminal of a voltage buffer circuit for producing a reverse bias voltage and sets a loop gain to a value less than 1.

Preferably, the peak holding means is constituted of a voltage buffer circuit, a first resistor which is connected to an output terminal of the buffer circuit and constitutes a charging time constant, and a capacitor for peak-holding purposes connected to the voltage buffer circuit by way of the first resistor; a second resistor constituting a discharging time constant is connected in parallel with the capacitor; and the feedback level adjustment means is constituted of the first resistor and the second resistor.

In the apparatus for driving a luminescent display panel according to the invention, constant-current sources are provided for the respective drive lines, a constant current is selectively supplied to each light-emitting element in a scanning state via a corresponding constant-current source, and a drive voltage supplied to the constant-current sources provided for the respective drive lines is set on the basis of a peak value held by the peak holding means.

In this case, the drive voltage supplied to the constant current sources is fed by a DC-DC converter; an output voltage of the DC-DC converter is controlled on the basis of a difference between a reference voltage and a voltage produced by dividing the output voltage; and the divided voltage is controlled on the basis of a peak value held by the peak holding means.

In this case, even in a preferred scanning state in which the plurality of scanning lines are sequentially scanned, a resetting operation is performed for setting all the drive lines and scanning lines to an identical potential at the end of each scanning period. The above-described configurations can be appropriately utilized for an apparatus for driving a luminescent display panel using an organic electroluminescent elements as light-emitting elements.

A method of driving a luminescent display panel according to the invention is characterized in that the panel includes a plurality of drive lines and scanning lines which cross each other; and a plurality of capacitive light-emitting elements connected to the drive lines and scanning lines at respective interconnections and having polarities, wherein, in a state in which a light-emitting element is driven and illuminated by means of setting any one of the scanning lines as a reference potential, control is performed for changing a value of a reverse bias voltage to be applied to the scanning line, as required, in response to a voltage developing in a scanning line in a non-scanning state via parasitic capacitance of the light-emitting element in a non-scanning state.

In this case, a voltage developing in a scanning line in a non-scanning state is preferably subjected to peak holding via parasitic capacitance of the light-emitting element in a non-scanning state. On the basis of the voltage value that has been subjected to peak holding, a value of a reverse bias voltage to be applied to the scanning line is produced. In addition, desirably the voltage that has been subjected to peak holding is gradually discharged.

By means of the apparatus for driving a luminescent display panel adopting the foregoing driving method, there is utilized the value of a voltage arising in a scanning line via parasitic capacitance of a light-emitting element in a non-scanning state; that is, a forward voltage of the light-emitting element. On the basis of the voltage value, a reverse bias voltage VM to be applied to the scanning line is controlled. For example, if the forward voltage Vf of EL elements constituting the luminescent display panel has arisen for reasons of long-term use, control is performed such that the reverse bias voltage VM also rises in pursuit of the forward voltage Vf. As a result, a potential difference between the forward voltage Fv of the EL elements and the reverse bias voltage VM is maintained within a predetermined range at all times.

If the cathode resetting method is adopted for the apparatus for driving the luminescent display panel, a charging voltage corresponding to the bias voltage VM with which the EL elements are initially charged immediately before scanning operation is at all times maintained at a level close to the peak value of the forward voltage Vf of the element. Hence, there can be prevented occurrence of a delay, which would otherwise arise in the time at which the EL elements start illuminating by an initial charging operation. Further, the reverse bias voltage VM does not rise higher than the forward voltage Vf, and hence there is prevented occurrence of excessive illumination damage, which would otherwise be caused by excessive recharging. Consequently, the EL element illuminates optimally instantaneous with commencement of scanning operation. Hence, the quantity of illumination of the EL element can be controlled so as to become substantially constant.

Even if a rise arises in the forward voltage Vf of the EL element for reasons of long-term use, the quantity of illumination of the EL element is controlled so as to become substantially constant. Hence, a period during which a predetermined quantity of illumination of the EL element can be ensured; that is, the life of the EL element, can be prolonged.

The reverse bias voltage VM which is controlled so as to become an appropriate value in pursuit of the forward voltage Vf of the EL element is supplied to each of the EL elements connected to the intersections between the driven anode line and the cathode lines not selected for scanning. Hence, there can be effectively inhibited occurrence of crosstalk illumination, which would otherwise be caused by the EL elements. Further, there can be prevented occurrence of a problem of deterioration of display grade of the display panel, which would otherwise be caused by the previously-described leakage phenomenon.

The foregoing effects similarly apply to variations in a forward voltage due to variations; e.g., in film-growth (deposition) treatment performed at the time of production of an EL element or a change in forward voltage of an EL element, which would otherwise arise according to the color of illumination of the EL element. Hence, a stable and optimized illumination characteristic can be achieved at all times without particular adjustment of an operating point of a circuit.

DETAILED DESCRIPTION OF THE PREFERRED EMBODIMENTS

Now, a description will be given in more detail of preferred embodiments of the invention with reference to the accompanying drawings.

Figure 6:
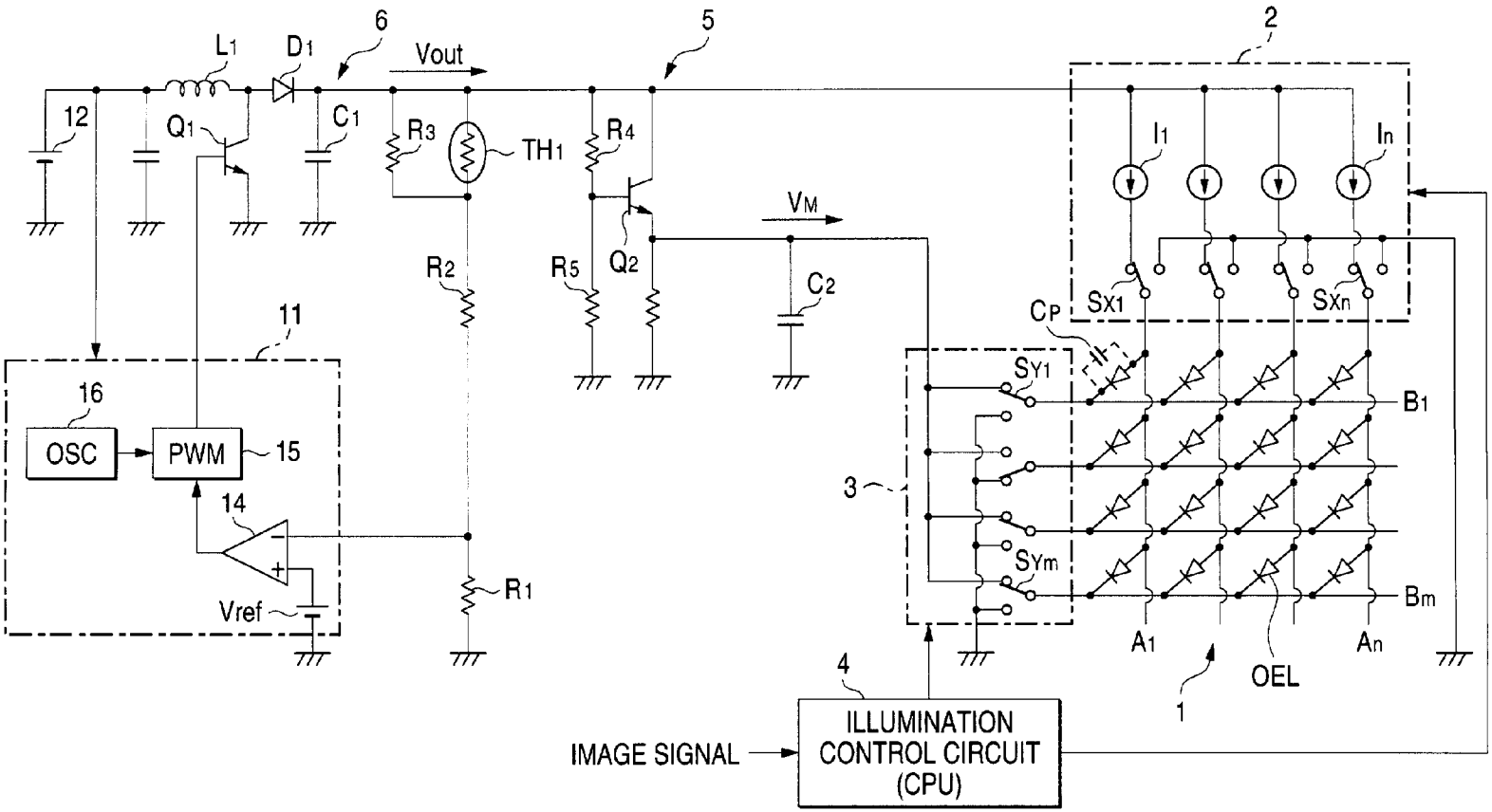
FIG. 6 is a schematic diagram showing an example of a related-art driving apparatus.
Figure 7A:
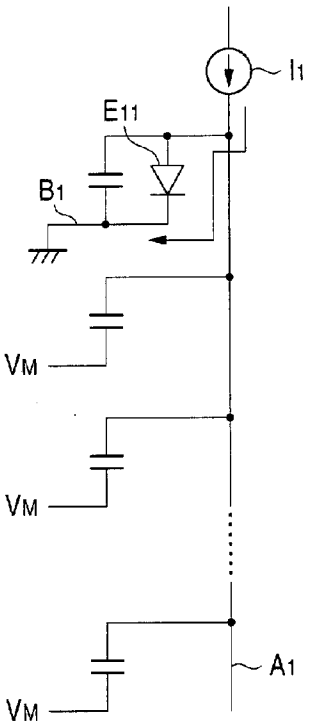
FIG. 7 is a schematic diagram for describing a cathode resetting method.
Figure 7B:
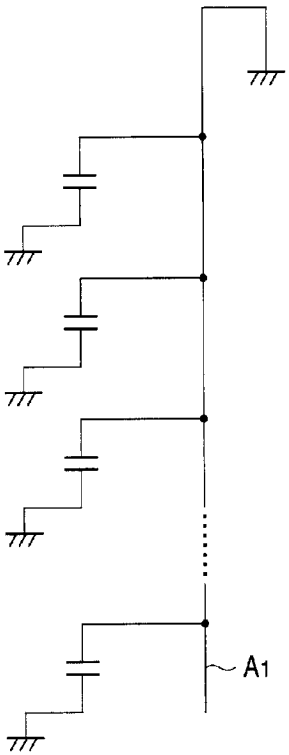
Figure 7C:
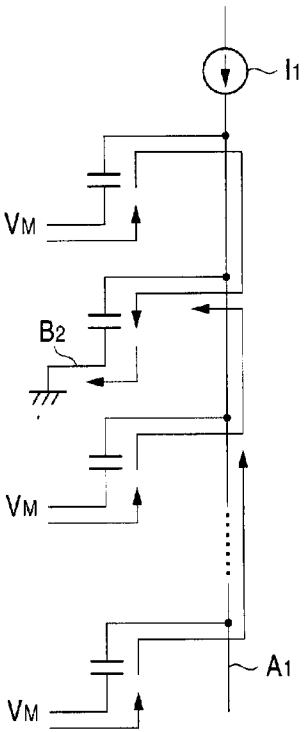
Figure 7D:
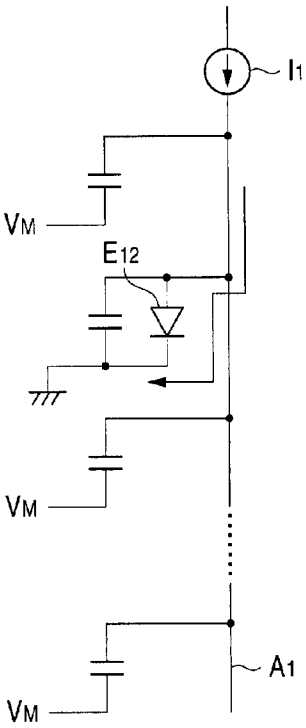

A first embodiment of an apparatus for driving a luminescent display panel according to the invention will be hereinafter described by reference to FIG. 1. In relation to FIG. 1, constituent elements corresponding to those that have already been described and shown in FIG. 6 are assigned the same reference numerals, and their detailed descriptions are omitted, as required. Reference numeral 21 shown in FIG. 1 designates a peak holding circuit. Here, the peak holding circuit 21 is constituted of an operational amplifier OP1, a diode D3, a resistor R6, and a capacitor C3.

A non-inverse input terminal of the operational amplifier OP1 constitutes an input terminal of the peak holding circuit 21. By way of scanning switches SY1 through SYm in the cathode line scanning circuit 3, the non-inverse input terminal of the operational amplifier OP1 is connected to cathode lines B1 through Bm when in a non-scanning state. An output terminal of the operational amplifier OP1 is connected to an anode of the diode D3, and the cathode of the diode D3 is connected to a non-inverse input terminal of the operational amplifier OP1. As a result, a known non-inverse half-wave rectifier is constituted between the non-inverse input terminal of the operational amplifier OP1 and the cathode of the diode D3.

A resistor R6 is connected to the cathode of the diode D3; that is, an output terminal of the half-wave rectifier. The capacitor C3 for peak holding purpose is connected to the diode D3 via the resistor R6. A resistor R7, which constitutes discharging means, is connected in parallel with the capacitor C3. By means of such a configuration, the resistor R6 defines a charging time constant in combination with the capacitor C3. Further, the resistor R7 defines a discharging time constant in combination with the capacitor C3. The peak holding circuit operates so as to hold a half-wave rectified output divided by the resistors R6 and R7. As a result, the resistors R6 and R7 constitute means for adjusting a feedback level.

A terminal voltage (a peak value held) is supplied to a reverse bias voltage generation circuit 5. In the embodiment, the reverse bias voltage generation circuit 5 is constituted of an operational amplifier OP2, a diode D4, and resistors R8, R9. The operational amplifier OP2 and the diode D4 in combination constitute a voltage buffering circuit having a half-wave rectification function. An output of the voltage buffer circuit can be supplied to an input terminal of the peak holding circuit by way of a voltage dividing circuit consisting of the resistors R8 and R9. In other words, an output from the reverse bias voltage generation circuit 5 can be supplied to the cathode lines B1 through Bm by way of the scanning switches SY1 through SYm.

A switch SW is connected in parallel with the capacitor C3 for peak holding purpose. The switch SW constitutes peak-value resetting means which is activated in response to an instruction signal output from a illumination control circuit 4, and as a result of activation momentarily discharges the electric charges stored in the capacitor C3.

The peak holding circuit 21 having the foregoing configuration and the reverse bias voltage generation circuit 5 constitute one closed loop. In the peak holding circuit 21, the resistors R6, R7 constitute a voltage dividing circuit; that is, means for adjusting a feedback level. Even in the reverse bias voltage generation circuit 5, the resistors RB, R9 constitute a voltage dividing circuit; that is, means for adjusting a feedback level.

The feedback level adjustment means is configured such that a closed loop consisting of the peak holding circuit 21 and the reverse bias voltage generation circuit 5 assumes a value of less than one, thereby avoiding occurrence of oscillation in the closed loop. Even when the closed loop has not entered an oscillating state, there is avoided occurrence of a phenomenon in which individual potentials of the loop remain at and eventually become locked to high voltages under influence of a transient phenomenon, such as fluctuations in an operation source voltage.

By means of the foregoing configuration, the scanning switches SY1 through SYm and the drive switches SX1 through SXn are activated in accordance with an image signal supplied from the illumination control circuit 4. More specifically, constant current circuits I1 through In are connected to the anode drive lines SX1 through SXn in accordance with an image signal while the cathode scanning lines SY1 through Sym are set to a reference potential at a predetermined cycle. As a result, EL elements OEL provided in a luminescent display panel 1 are selectively illuminated, whereupon an image is reproduced from the image signal on the display panel 1.

When any one of the EL elements OEL is illuminated and displayed, a forward voltage Vf of that EL element develops in the drive line connected to the EL element. When the forward voltage Vf has exceeded the reverse bias voltage VM, the forward voltage Vf flows into the cathode scanning lines in a non-scanning state so as to recharge parasitic capacitance Cp of each EL element in a non-scanning state, thus boosting the voltage across the resistor R9. Consequently, a peak voltage Vp corresponding to the forward voltage Vf is supplied to a non-inverse input terminal of the operation amplifier OP1 by way of the scanning switches SY1 through SYm. A voltage corresponding to the peak value of the forward voltage Vf is held by the capacitor C3.

The peak voltage value held by the capacitor C3 is supplied to the reverse bias voltage generation circuit 5 wherein the reverse bias voltage produced by the reverse bias voltage generation circuit 5 is supplied to respective cathode terminals of the EL elements in a non-scanning state as a reverse bias voltage VM, by way of the scanning switches SY1 through SYm. If the forward voltage Vf of the EL element rises with long-term use or for reasons of changes in ambient temperature, the reverse bias voltage VM output from the reverse bias voltage generation circuit 5 also rises so as to follow the rise in the forward voltage Vf. The capacitor C3 constituting a peak holding circuit is connected to the discharging resistor R7. Consequently, if a peak value of the forward voltage Vf of the EL element drops, the reverse bias voltage VM output from the reverse bias voltage generation circuit 5 also falls so as to follow the drop.

In this way, the reverse bias voltage VM output from the reverse bias voltage generation circuit 5 follows a value corresponding to the peak value of the forward voltage Vf of the EL element at all times. The reverse bias voltage VM of appropriate value is supplied to respective EL elements connected to intersections of the cathode lines not selected for scanning, thereby effectively inhibiting occurrence of crosstalk illumination in the respective EL elements. In this case, there is also avoided deterioration of display grade of a display panel, which would otherwise be caused by the foregoing leakage phenomenon, as well as deterioration of elements, which would otherwise be caused by excessive charging.

The reverse bias voltage VM output from the reverse bias voltage generation circuit 5 is utilized as a voltage which is to charge parasitic capacitance of the EL element to be driven and illuminated in the next scanning operation through the cathode resetting operation. Even in this case, the reverse bias voltage VM is set so as to follow a potential slightly lower than the peak value of the forward voltage Vf of the EL element. By means of the cathode resetting operation, the parasitic capacitance of the EL element to be illuminated in the next scanning operation is charged with a potential which enables instantaneous illumination.

The EL element momentarily illuminates simultaneous with commencement of a scanning operation. Hence, the quantity of illumination of the EL element can be controlled so as to become constant at all times. In other words, even if the forward voltage Vf of the EL element rises with long-term use, the EL element is illuminated immediately after the scanning period and remains illuminated over the scanning period. Consequently, a period of time during which a predetermined quantity of illumination of an EL element can be ensured; that is, the life of an EL element can be prolonged substantially.

The switch SW constituting the peak value resetting means is toggled on in accordance with an instruction signal output from the illumination control circuit 4, thereby resetting the peak voltage. This is performed when the forward voltage Vf of the EL element to be illuminated in the next scanning operation drops abruptly. For example, when information for decreasing luminance is included in an image signal continually supplied to the illumination control circuit 4, the illumination control circuit 4 can acquire the information before the display panel 1 is driven. On the basis of the information, the switch SW is momentarily activated.

In a case where the display panel 1 constitutes a multicolor screen by means of arranging EL elements of different luminescent colors, resetting is performed in the same manner as mentioned previously at a moment in which a shift arises from scanning of, e.g., an EL element of blue (B) illumination involving a high forward voltage, to scanning of an EL element of green (G) illumination involving a low forward voltage. As a result, there can be avoided application of an excessive reverse bias voltage VM to the EL element to be illuminated in the next scanning operation.

Figure 1:
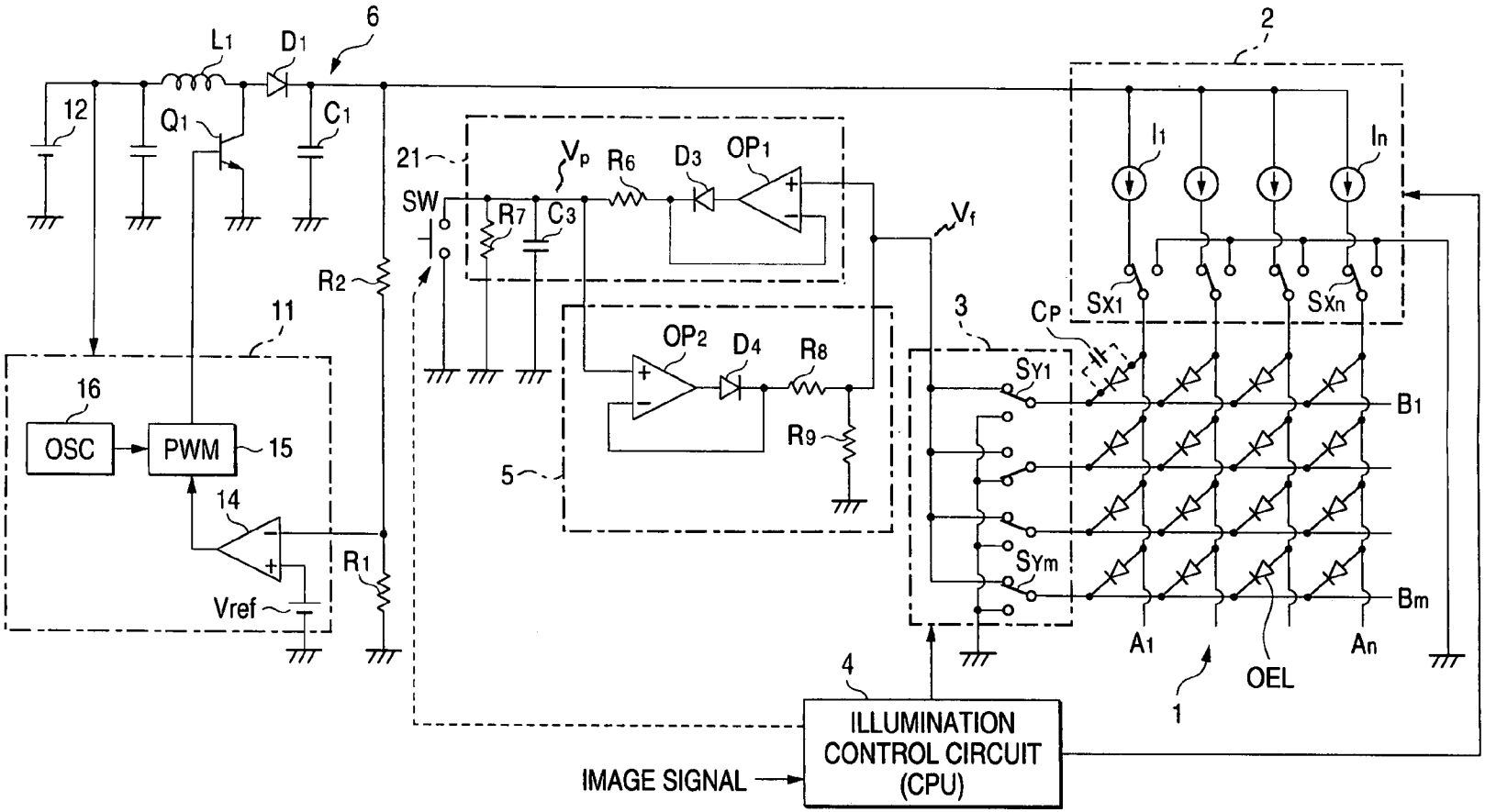
FIG. 1 is a schematic diagram showing a first embodiment of a driving apparatus according to the invention.
Figure 2:
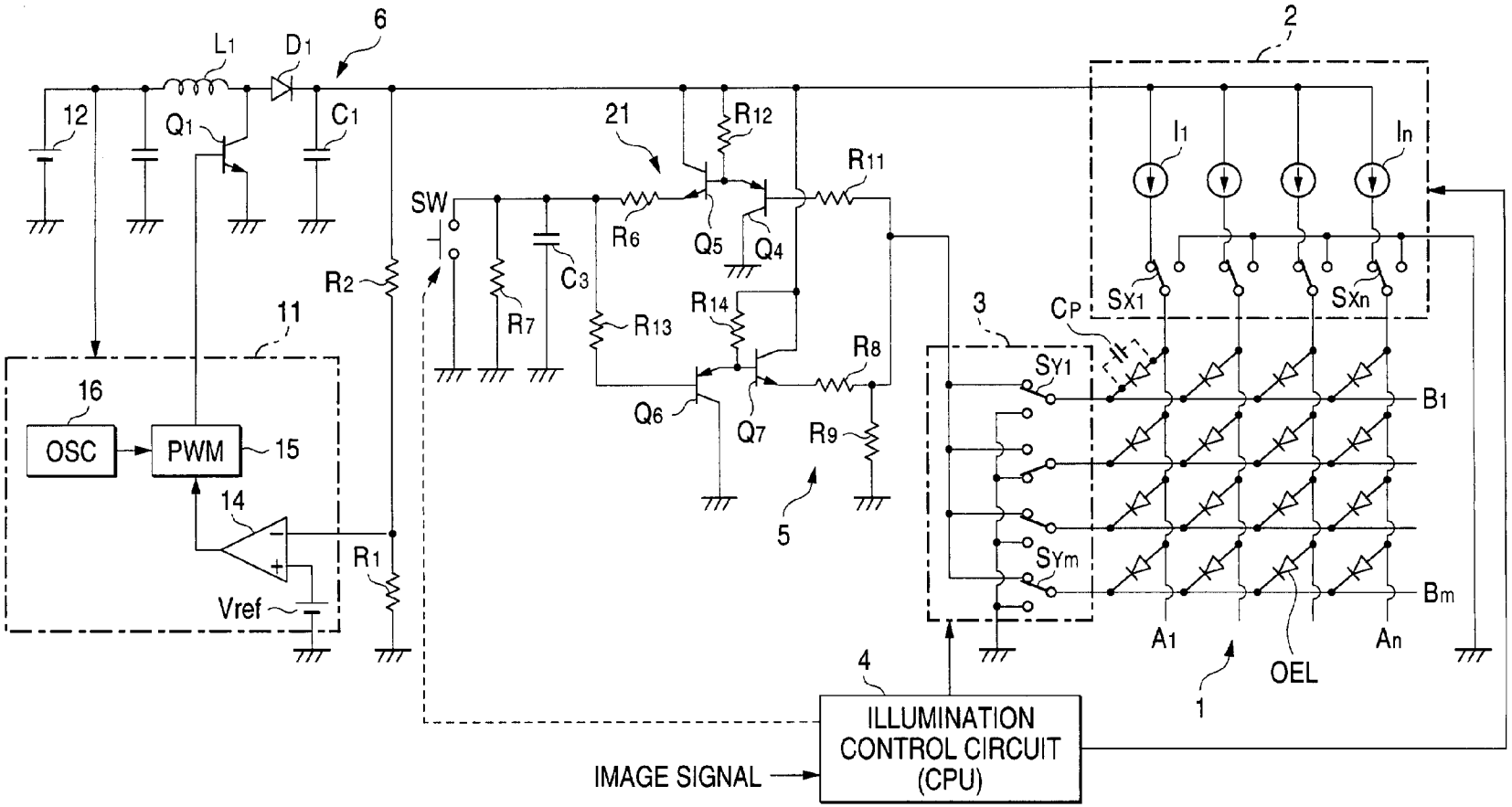
FIG. 2 is a similar schematic diagram, showing a second embodiment.

FIG. 2 shows a second embodiment of the drive apparatus according to the invention. In relation to FIG. 2, constituent elements corresponding to those that have been described and shown in FIGS. 1 and 6 are assigned the same reference numerals, and hence their detailed explanations are omitted. In the second embodiment shown in FIG. 2, the peak holding circuit 21 and the reverse bias voltage generation circuit 5 are constituted of a comparatively simple discrete circuit. In other respects, the apparatus is identical with that shown in FIG. 1.

The voltage buffer constituting the peak holding circuit 21 is constituted of the p-n-p transistor Q4 and the n-p-n transistor Q5. A voltage corresponding to the peak value of the forward voltage Vf of the EL element is supplied to the base of the first p-n-p transistor stage Q4 by way of a resistor R11 for increasing an oscillation margin. The collector of the transistor Q4 is grounded, and the emitter of the same is connected to an operating power source by way of a resistor R12. Thus, the transistor Q4 constitutes an emitter follower.

The base of the next n-p-n transistor stage Q5 is connected to the emitter of the previous transistor stage Q4. The collector of the transistor Q5 is connected to the operating power source, and the emitter of the same is grounded via resistors R6, R7. Thus, the second transistor stage Q5 also constitutes an emitter follower. The capacitor C3 for peak holding purpose is recharged with an output from a voltage buffer consisting of two emitter followers, and the capacitor C3 holds a voltage corresponding to the peak value of the forward voltage Vf of the EL element.

Even the reverse bias voltage generation circuit 5 also constitutes a similar voltage buffer. More specifically, a terminal voltage of the capacitor C3 is supplied to the base of a first p-n-p transistor stage Q6 by way of a resistor R13 for increasing an oscillation margin. The collector of the transistor Q6 is grounded, and the emitter of the same is connected to the operating power source by way of a resistor R14. The transistor Q6 constitutes an emitter follower.

The base of the next n-p-n transistor stage Q7 is connected to the emitter of the preceding transistor stage Q6. The collector of the transistor Q7 is connected to the operating power source, and the emitter of the same is grounded by way of resistors R8, R9. Thus, the second transistor stage Q7 also constitutes an emitter follower. An output from the transistor Q7 is extracted as a voltage divided by the emitter resistors R8, R9.

By means of the circuit configuration shown in FIG. 2, each of the peak holding circuit 21 and the reverse bias voltage generation circuit 5 is configured into a two-stage emitter follower. These circuits operate in the same manner as shown in FIG. 1.

Figure 3:
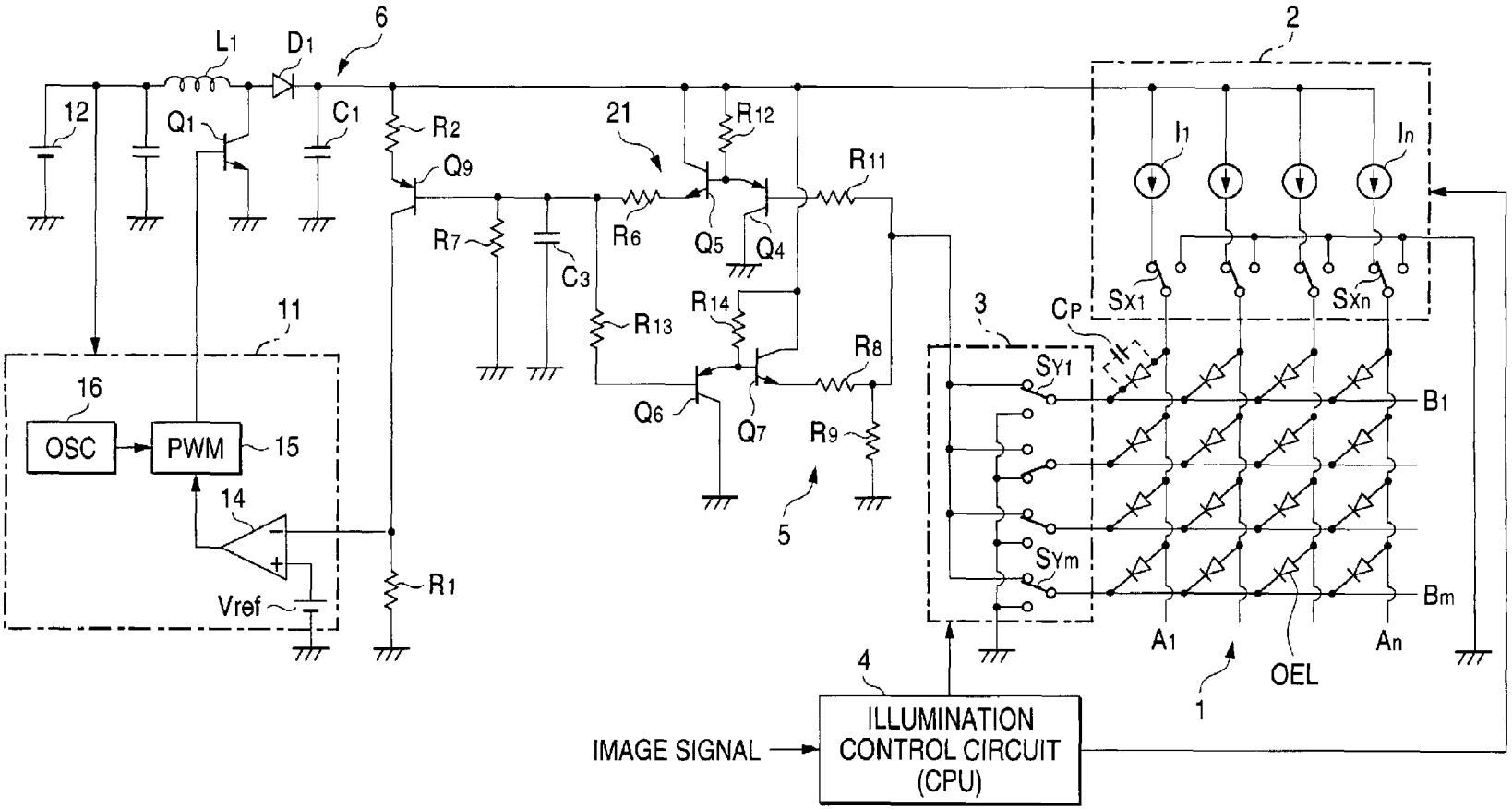
FIG. 3 is a similar schematic diagram, showing a third embodiment.
Figure 4:
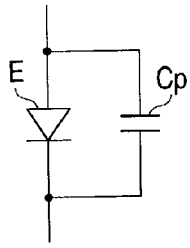
FIG. 4 is a diagram showing an equivalent circuit of an organic EL element.

FIG. 3 shows a third embodiment of the driving apparatus according to the invention. The apparatus shown in FIG. 3 is identical in principal configuration with that shown in FIG. 2, and corresponding elements are assigned the same reference numerals. Hence, their detailed explanations are omitted. In the embodiment shown in FIG. 3, a boosted output from a DC-DC converter is controlled by utilization of a voltage appearing in the terminal of the capacitor C3 held by the peak holding circuit 2, thereby diminishing power loss associated with driving of the display panel 1.

In the embodiment shown in FIGS. 1 and 2, an output from the DC-DC converter 6 to be applied to the respective constant current circuits I1 through In in the anode line drive circuit 2 is controlled so as to become a substantially-constant output voltage (constant voltage) at all times, by means of, e.g., a switching regulator utilizing the PWM system. In this case, there is no alternative but to set the voltage output from the DC-DC converter 6 to a high voltage, in consideration of the following elements, so as to be able to ensure a sufficient constant current characteristic of the constant current circuit in the anode line drive circuit 2.

Figure 5A:
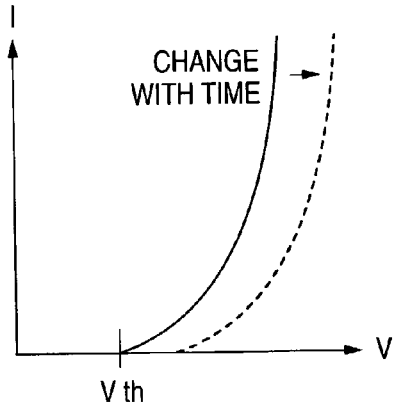
FIGS. 5A to 5C are graphs showing characteristics of the organic EL element, respectively.
Figure 5B:
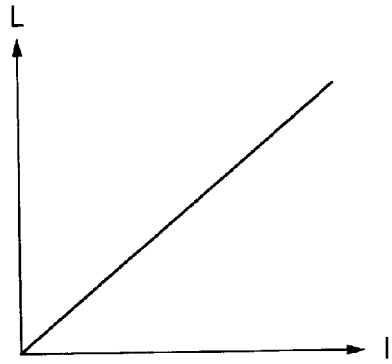
Figure 5C:
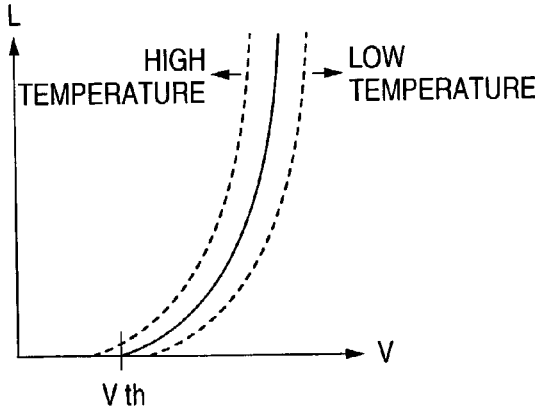

More specifically, the elements include: constant allowance of each of circuit components constituting the switching regulator circuit 11; variations in the level of a voltage drop arising in each of the constant current circuits I1 through In; an increase in forward voltage stemming from long-term use of the EL element which have been described by reference to FIG. 5A; and a fluctuation in forward voltage stemming from temperature dependence of an EL element described by reference to FIG. 5C. In the apparatus for driving a luminescent display panel, the voltage output from the DC-DC converter 6 is set to a higher value so as to be able to ensure a sufficient constant current characteristic of the constant current circuits I1 through In even when these elements operate in a synergistic manner.

However, when the voltage output from the DC-DC converter 6 is set to a high value, there is entailed excessive power loss in many cases. For example, when the apparatus is adopted for portable terminal equipment, there is entailed heat generation due to power loss as well as contribution to depletion of a battery. More specifically, when the output voltage is set to a higher value, a voltage drop arising in each of the constant current circuits I1 through In in the anode line drive circuit 2 becomes greater eventually. In proportion to the voltage drop, power loss increases. Consequently, heat induced by power loss places stress to the organic EL element and peripheral circuit components, thus shortening the life of the EL element, as mentioned previously.

In the embodiment shown in FIG. 3, a p-n-p transistor Q9 is interposed between the resistors R1 and R2 in the DC-DC converter 6. Further, the base of the p-n-p transistor Q9 is supplied with the terminal voltage of the capacitor C3 held by the peak holding circuit 21. Hence, a voltage corresponding to the forward voltage Vf of the EL element in a driven state is applied to the base of the transistor Q9. The transistor Q9 acts as a current buffer, and the emitter current of the transistor Q9 is substantially equal to the collector current.

When the terminal voltage of the capacitor C3 is taken as Vm, the emitter/base voltage (Vbe) of the transistor Q9 is superimposed on the terminal voltage Vm. The resultant voltage is applied to the resistor R2, as a result of which the output voltage of the DC-DC converter 6 increases in accordance with the voltage Vm. The voltage output from the DC-DC converter 6 is fed back by way of the switching regulator circuit 11 through PWM. Hence, the voltage to be output from the DC-DC converter 6 is determined from a ratio of the resistor R1 to the resistor R2 and a parameter of the reference voltage Vref. Consequently, an output voltage Vout1 produced by the DC-DC converter 6 by means of the circuit configuration shown in FIG. 2 can be expressed as follows.

$$Vout1 = Vm + Vref \times (R2/R1) + Vbe$$

As is evident from the foregoing description, the voltage Vout1 to be output from the DC-DC converter 6 having the circuit configuration shown in FIG. 3 consequently corresponds to a peak value of the forward voltage of the EL element. The voltage Vout1 to be output from the DC-DC converter 6 changes in accordance with the forward voltage of the EL element. Therefore, the configuration shown in FIG. 3 obviates a necessity of setting the output voltage of the DC-DC converter 6 to a high value by means of increasing the useless margin added to each element, which has been performed by the driving apparatus shown in FIGS. 1 and 2.

In other words, the DC-DC converter can produce an optimized output voltage to such an extent that the constant current characteristics of the constant current circuits I1 through In for driving and illuminating the EL elements can be ensured at all times. As a result, a voltage drop arising in the constant current circuits I1 through In can be controlled so as to become a minimum level, thereby effectively inhibiting occurrence of power loss, which would otherwise arise in the constant current circuits. Even when the forward voltage of the EL element has increased for reasons of, e.g., changes over time, the voltage Vout1 output from the DC-DC converter 6 can follow the increase. Further, the output voltage can also follow changes in forward voltage due to temperature dependence of the EL element.

The circuit configuration shown in FIG. 3 is not provided with the switch SW which is shown in FIGS. 1 and 2 and serves as the peak value resetting means. The switch may be provided, as required.

As is obvious from the foregoing description, in the apparatus for driving a luminescent display panel employing the driving method according to the invention, a reverse bias voltage value to be applied to scanning lined is changed, as required, in accordance with a peak value of a forward voltage of a light-emitting element in an illuminated state. Hence, an optimized reverse bias voltage can be obtained at all times, thereby effectively inhibiting occurrence of crosstalk illumination. Even when a forward voltage of the element is increased for reasons of, e.g., long-term use of a light-emitting element, a drop in luminance is not entailed, thus enabling substantial elongation of life of a light-emitting element. Further, an identical drive circuit can be adopted for display panels of different colors whose light-emitting elements differ in forward voltage from each other, thus contributing to curtailment of costs.

What is claimed is:

1. An apparatus for driving a luminescent display panel, the panel including a plurality of drive lines and scanning lines, which cross each other, and a plurality of capacitive light-emitting elements, wherein the light-emitting elements are connected to the drive lines and scanning lines at respective interconnections and have polarities, the apparatus comprising:

reverse bias voltage generation means which changes a value of a reverse bias voltage to be applied to the scanning lines in accordance with a forward voltage value of a light-emitting element obtained in an illuminated state, wherein said value of said reverse bias voltage changes in response to obtaining said forward voltage value, wherein a voltage corresponding to the forward voltage value of the light-emitting element obtained in an illuminated state is acquired from a line voltage of the corresponding scanning line obtained when the light-emitting element is in a non-scanning state.

2. The apparatus according to claim 1, wherein the light-emitting elements are organic electroluminescent elements.

3. The apparatus according to claim 1, further comprising scanning switches connected to the respective scanning lines, wherein a reverse bias voltage produced by the reverse bias voltage generation means is applied to the respective scanning lines via the respective scanning switches; and a line voltage of a scanning line in a non-scanning state is acquired by way of a corresponding scanning switch.

4. The apparatus according to claim 1, further comprising:

peak holding means for holding a peak value of a line voltage of the respective scanning line in a non-scanning state, wherein a value of the reverse bias voltage produced by the reverse bias voltage generation means is controlled on the basis of a peak value held by the peak holding means.

5. The apparatus according to claim 4, wherein the peak holding means has electric discharging means for gradually discharging a held peak value.

6. The apparatus according to claim 4 or 5, wherein the peak holding means has peak value resetting means capable of instantaneously resetting a held peak value.

7. The apparatus according to claim 6, wherein the peak value resetting means is configured so as to perform a resetting operation in accordance with an instruction signal output from a light-emission control circuit which drives a luminescent display panel in accordance with an image signal.

8. The apparatus according to claim 4, wherein the reverse bias voltage generation means is constituted of a voltage buffer circuit which produces a reverse bias voltage in accordance with a peak value held by the peak holding means.

9. The apparatus according to claim 8, further comprising feedback level adjustment means which is provided in a loop path from an input terminal of the peak holding means to an output terminal of a voltage buffer circuit for producing a reverse bias voltage and which sets a loop gain to a value less than 1.

10. The apparatus according to claim 9, wherein the peak holding means comprises: a voltage buffer circuit, a first resistor which is connected to an output terminal of the buffer circuit and constitutes a charging time constant, and a capacitor for peak-holding purposes connected to the voltage buffer circuit through the first resistor;

wherein a second resistor constituting a discharging time constant is connected in parallel with the capacitor, and the feedback level adjustment means comprises the first resistor and the second resistor.

11. The apparatus according to claim 4 or 5, wherein constant-current sources are provided for the respective drive lines, and a constant current is selectively supplied to each light-emitting element in a scanning state via a corresponding constant-current source; and a drive voltage supplied to the constant-current sources provided for the respective drive lines is set on the basis of a peak value held by the peak holding means.

12. The apparatus according to claim 11, wherein the drive voltage supplied to the constant current sources is fed by a DC-DC converter; an output voltage of the DC-DC converter is controlled on the basis of a difference between a reference voltage and a voltage produced by dividing the output voltage; and the divided voltage is controlled on the basis of a peak value held by the peak holding means.

13. The apparatus according to claim 6, wherein the reverse bias voltage generation means is constituted of a voltage buffer circuit which produces a reverse bias voltage in accordance with a peak value held by the peak holding means.

14. The apparatus according to claim 1, wherein, in a scanning state in which the plurality of scanning lines are sequentially scanned, a resetting operation is performed for setting all the drive lines and scanning lines to an identical potential at the end of each scanning period.

15. The apparatus according to claim 14, wherein the light-emitting elements are organic electroluminescent elements.

16. A method of driving a luminescent display panel, the panel comprising:

a plurality of drive lines and scanning lines which cross each other; and a plurality of capacitive light-emitting elements connected to the drive lines and scanning lines at respective interconnections and have polarities, wherein, in a state in which a light-emitting element is driven and illuminated by means of setting any one of the scanning lines as a reference potential, control is performed for changing a value of a reverse bias voltage to be applied to the scanning line, as required, in response to a voltage developing in a scanning line in a non-scanning state via parasitic capacitance of the light-emitting element in a non-scanning state.

17. The method according to claim 16, wherein a voltage developing in a scanning line in a non-scanning state is subjected to peak holding via parasitic capacitance of the light-emitting element in a non-scanning state.

18. The method according to claim 17, wherein the voltage that has been subjected to peak holding is gradually discharged.

19. A display, comprising:

a plurality of first conductive lines;

a plurality of second conductive lines;

a plurality of light-emitting elements respectively connected between the first conductive lines and the second conductive lines;

a reverse bias voltage generation circuit that inputs a forward voltage applied across a particular light-emitting element of the plurality of light-emitting elements, wherein the reverse bias voltage generation circuit changes a value of a reverse bias voltage to be applied to at least one of the second conductive lines based on, and in response to, the forward voltage value that was input, wherein the forward voltage corresponds to a voltage value of the particular light-emitting element in an illuminated state, and wherein the forward voltage is input when the particular light-emitting element is not being scanned.

20. The display as claimed in claim 19, wherein the second conductive lines are scanning lines and the first conductive lines are drive lines.

21. The display as claimed in claim 19, wherein the forward voltage corresponds to the voltage across the particular light-emitting element when the particular light-emitting element is an illuminated state.

22. The apparatus according to claim 19, wherein the second conductive lines comprise scanning lines that are sequentially activated to sequentially scan groups of the light-emitting elements.

23. The apparatus according to claim 22, further comprising scanning switches respectively connected to the scanning lines, wherein the reverse bias voltage is applied to the scanning lines via the scanning swithches, respectively, and wherein the reverse bias generating circuit inputs the forward voltage of the particular light-emitting element from one of the scanning lines via the corresponding scanning switch.

* * * * *